United States Patent [19]

Hacker et al.

[11] Patent Number: 5,014,526

[45] Date of Patent: May 14, 1991

[54] TEXTILE WET PROCESSING MACHINE HAVING FABRIC CIRCULATION CHAMBER WITH ADJUSTABLE INNER WALL

[75] Inventors: George G. Hacker, Stanley; James K. Turner, Lincolnton; Paul L. Abernathy, Dallas; Bobby G. Payne, Alexis; Roy C. Killian, Stanley; David G. Laws, Alexis, all of N.C.

[73] Assignee: Gaston County Dyeing Machine Co., Stanley, N.C.

[21] Appl. No.: 586,260

[22] Filed: Sep. 21, 1990

[51] Int. Cl.[5] ..... D06B 3/28; D06B 17/02

[52] U.S. Cl. ..... 68/178

[58] Field of Search ..... 68/177, 178, 179

[56] References Cited

U.S. PATENT DOCUMENTS

| | | | |
|---|---|---|---|
| 1,209,880 | 12/1916 | Palmer | 68/178 |
| 3,921,420 | 11/1975 | Aurich et al. | 68/178 X |
| 3,949,575 | 4/1976 | Turner et al. | 68/178 X |
| 4,001,945 | 1/1977 | Aurich et al. | 34/155 |
| 4,007,517 | 2/1977 | Turner et al. | 68/177 X |
| 4,114,407 | 9/1978 | Turner et al. | 68/178 |
| 4,318,286 | 3/1982 | Sturkey | 68/178 |
| 4,340,986 | 7/1982 | Sturkey | 8/152 |

FOREIGN PATENT DOCUMENTS

| | | | |
|---|---|---|---|
| 2945942 | 5/1981 | Fed. Rep. of Germany | 68/178 |

*Primary Examiner*—Philip R. Coe

*Attorney, Agent, or Firm*—Shefte, Pinckney & Sawyer

[57] ABSTRACT

A textile wet processing machine of the type wherein an endless fabric rope is circulated in plug form through a U-shaped chamber having perforated side walls is equipped with an inner wall having lateral flanges for mounting by special fasteners in differing dispositions between the chamber side walls utilizing the existing perforations therein to selectively vary the cross-sectional size of the chamber to accommodate particular processing requirements of differing fabrics.

8 Claims, 4 Drawing Sheets

TEXTILE WET PROCESSING MACHINE HAVING FABRIC CIRCULATION CHAMBER WITH ADJUSTABLE INNER WALL

BACKGROUND OF THE INVENTION

The present invention relates generally to textile wet processing machines and, more particularly, to such machines for wet processing textile fabrics in continuous cloth rope form.

Textile wet processing machines have long been utilized in the textile industry for piece dyeing of textile fabrics in endless cloth rope form. In machines of this type, e.g., jet dyeing machines, the endless fabric rope is circulated through a processing chamber containing treating liquid, wherein the cloth rope is formed in a plaited plug form. The cloth plug advances through the treating chamber by continuous drawing off of the leading end of the plug and conveyance thereof to the trailing end of the plug, commonly accomplished by means of a fabric lifting reel and a downstream jet of the treating liquid.

A common form of treating chamber utilized in such textile wet processing machines is of a U-shape defined by a pair of laterally-spaced U-shaped side walls joined at their outer edges by a U-shaped transverse wall. The chamber is situated in the bottom of the treating vessel, the side walls typically being perforated to permit flow of the treating liquid therethrough between the interior of the chamber and the bottom liquid containment area of the vessel. It is also common to provide an inner transverse wall between the inner edges of the perforated side walls to maintain the fabric plug at least partially submerged in the treating liquid within the vessel.

Disadvantageously, however, the provision of a treating chamber with an inner wall restricts the chamber to a defined volume which may limit the flexibility of the wet processing machine for treating different types of fabrics. As will be understood, fabrics having different characteristics, e.g., different thicknesses and weight per yard, will behave differently in the wet processing machine and therefore may require a treating chamber of differing volumetric size in order to enable the machine to realize its maximum capacity for treating the individual fabric. However, when the treating chamber has an inner wall, the capacity of the machine for processing thicker and heavier fabrics may be limited thereby. Conversely, the machine may be less than optimally effective for treating lighter weight fabrics for which a treating chamber of relatively small volume would be preferred.

SUMMARY OF THE INVENTION

It is accordingly an object of the present invention to improve textile wet processing machinery of the aforementioned type by providing an adjustable inner wall for the processing chamber to enable the chamber to be selectively adapted to differing fabrics to be processed.

The improvement of the present invention is essentially adapted for use in generally any machine for wet processing of textile fabric in continuous cloth rope form wherein a vessel is provided for containing processing liquid and a U-shaped chamber is positioned within the vessel for circulation of the cloth rope therethrough in plug form, with the chamber having perforated side walls to permit liquid flow therethrough and an outer wall for advance of the cloth plug therealong. According to the present invention, an inner wall is provided for disposition between the side walls of the U-shaped chamber in spaced relation to the outer wall, with suitable means being provided for selectively affixing the inner wall to the side walls at selected perforations of the side walls for adjustably spacing the inner wall from the outer wall.

Preferably, the inner wall includes a flange at each lateral side thereof and the affixing means includes means for clamping each flange to a respective one of the side walls. In the preferred embodiment, the clamping means includes a plurality of fasteners each extendable through a perforation of the side walls and a clamp member associated with each fastener for clamping engagement with a flange of the inner wall. In this manner, the conventional perforations provided in the chamber side walls are utilized for selective mounting of the inner wall without requiring the provision of mating perforations in the inner wall.

It is further preferred that the inner wall be sufficiently flexible to assume a range of curvatures corresponding to differing dispositions of the inner wall affixed to the perforated side walls.

For many contemplated applications, the inner and outer chamber walls are preferably imperforate, but may also be perforated for other applications.

DESCRIPTION OF THE PREFERRED EMBODIMENT

Figure 1:
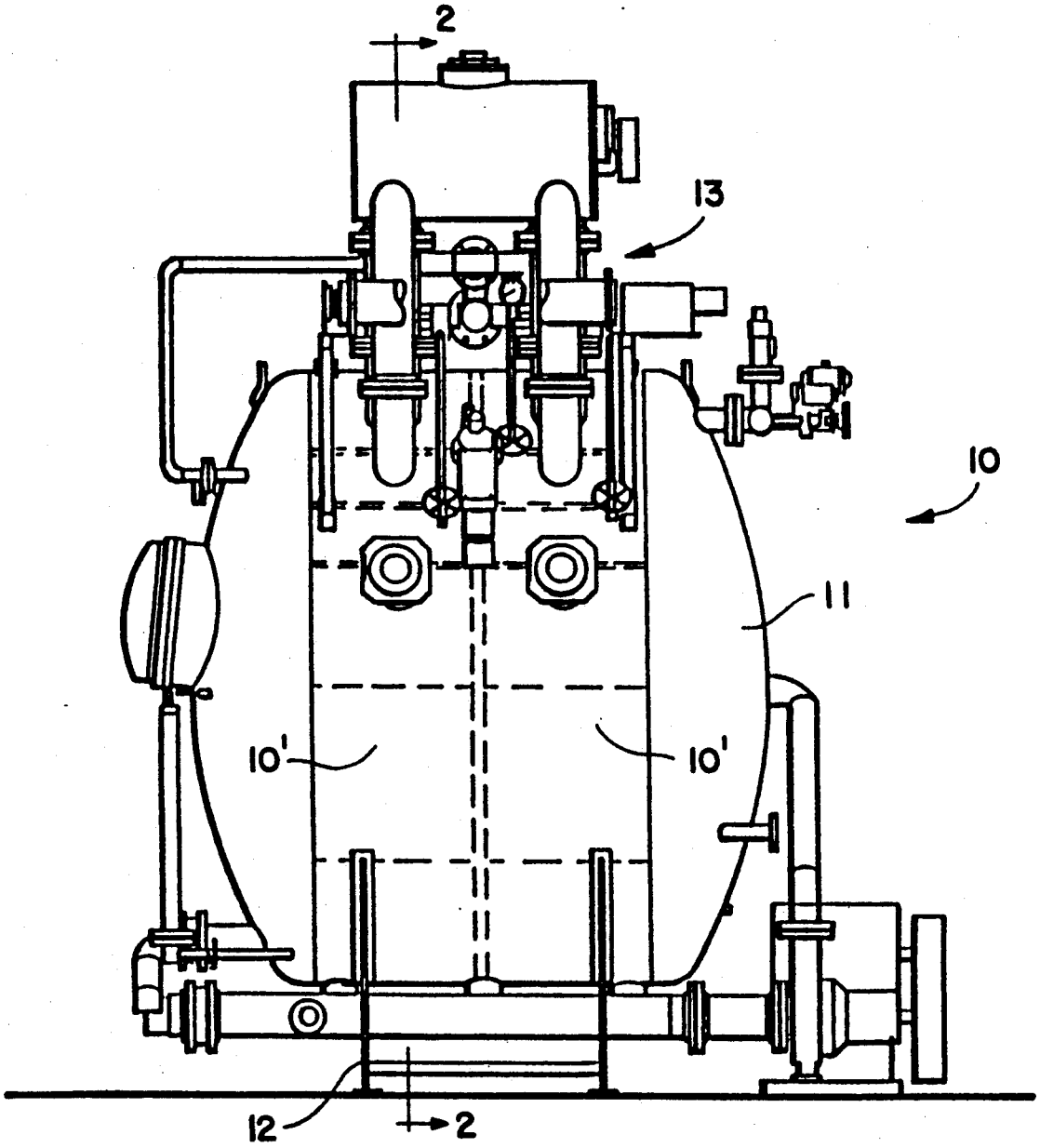
FIG. 1 is a side elevational view of a jetwet processing machine having treating chambers with adjustable inner walls according to the preferred embodiment of the present invention.
Figure 2:
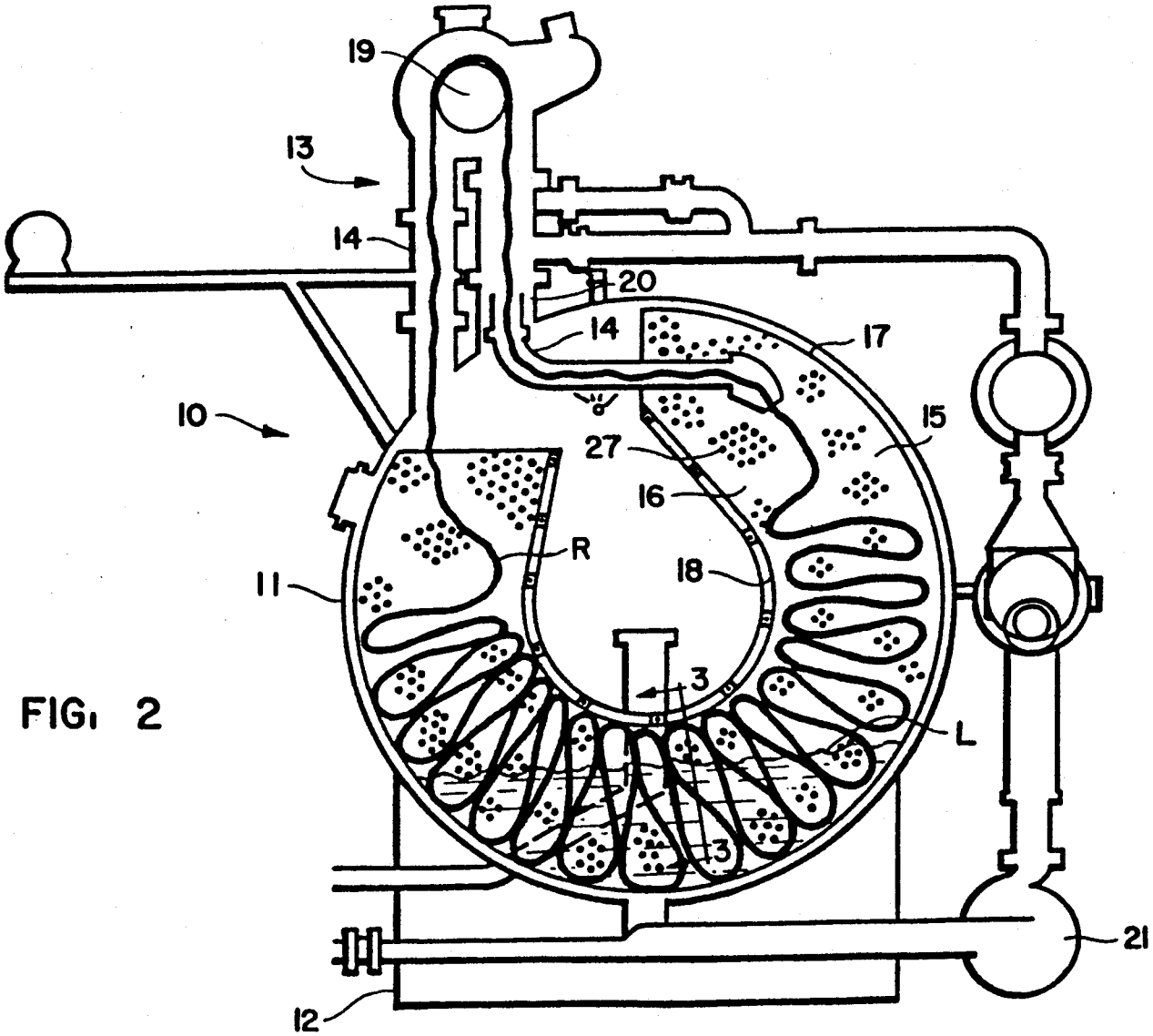
FIG. 2 is a vertical cross-sectional view of the wet processing machine of FIG. 1, taken along line 2—2 thereof.

Referring now to the accompanying drawings and initially to FIGS. 1 and 2, the present invention is illustrated as preferably embodied in a textile wet processing machine of the jet-type commonly employed for the dyeing of textile fabrics in a continuous cloth rope form, generally indicated at 10. As those persons skilled in the art will readily recognize and understand, varying forms of such textile wet processing machines are well known in the textile industry. Further, it is contemplated that the present invention may be readily adapted to and incorporated in many such machines. Accordingly, the machine 10 is herein illustrated and described only schematically to the extent necessary to facilitate an understanding of the present invention and to be representative of the application of the present invention to any suitable conventional wet processing machine.

Basically, the machine 10 includes a closed pressure vessel 11, typically of cylindrical form disposed with a generally horizontally-extending axis and mounted on a floor-supported base 12. Commonly, the machine 10 will be utilized for simultaneously processing several separate fabric pieces, each in continuous rope form. For this purpose, the axial extent of the cylindrical vessel is equipped with a plurality of treating sections or units 10' arranged side-by-side along the axial length of the machine, corresponding in number to the number of different fabric pieces to be treated in any given wet processing operation. In each section or unit 10', a U-shaped treating chamber 15 is disposed within the bottom of the vessel 11 and a corresponding superstructure 13 is mounted at the top of the vessel 11 for circulating a respective endless cloth rope R (formed by sewing together the opposite ends of an extended length of textile fabric) through the machine 10 for wet processing by a liquid L contained within the vessel 11. As will be understood, the machine 10 may be constructed with any desired number of treating sections or units, within practical limits. Only two such treating sections or units 10' are shown in FIG. 1 for simplicity of illustration.

A chamber 15 basically comprises a pair of U-shaped side walls 16 supported in facing parallel relation to one another spaced axially along the length of the vessel 11 by correspondingly U-shaped outer and inner walls 17, 18 extending transversely between the respective outer and inner edges of the side walls 16, the outer wall 17 being affixed to the interior of the vessel 11 to support the chamber 15 in place therein. As is conventional, the side walls 16 of the chamber 15 are perforated to permit liquid flow therethrough into and out of the interior of the chamber 15. The inner and outer walls 17, 18 may be perforate or imperforate as desired.

The superstructure 13 basically comprises a tubular conduit 14 mounted to the vessel 11 with the opposite ends of the conduit 14 aligned respectively with the opposite upward openings into the chamber 15. A driven lifter reel 19 is rotatably disposed within the conduit 14 for continuously and progressively withdrawing the fabric rope R from the chamber 15 into the conduit 14 and a conventional annular liquid jet nozzle 20 is provided in the conduit 14 downstream of the lifter reel 19 to continuously apply treating liquid L under pressure to the fabric rope R traveling through the conduit 14 in the same direction as the rope R travels and thereby also to provide a driving force to the rope R. A circulation pump 21 continuously withdraws treating liquid L from the bottom of the vessel 11 and delivers the withdrawn liquid under pressure to the nozzle 20.

The terminal end of the conduit 14 downstream of the jet nozzle 20 opens vertically downwardly into the opposite side of the chamber 15. As the cloth rope R and pressurized liquid L exit the conduit 14, the rope R settles into plaits or folds such that the fabric rope R assumes the general form of a plug within the chamber 15. The perforations in the side walls 16 of the chamber 15 enable the returning liquid L to flow therethrough into the bottom of the vessel 11 for recirculation through the pump 21 and the jet nozzle 20.

Figure 3:
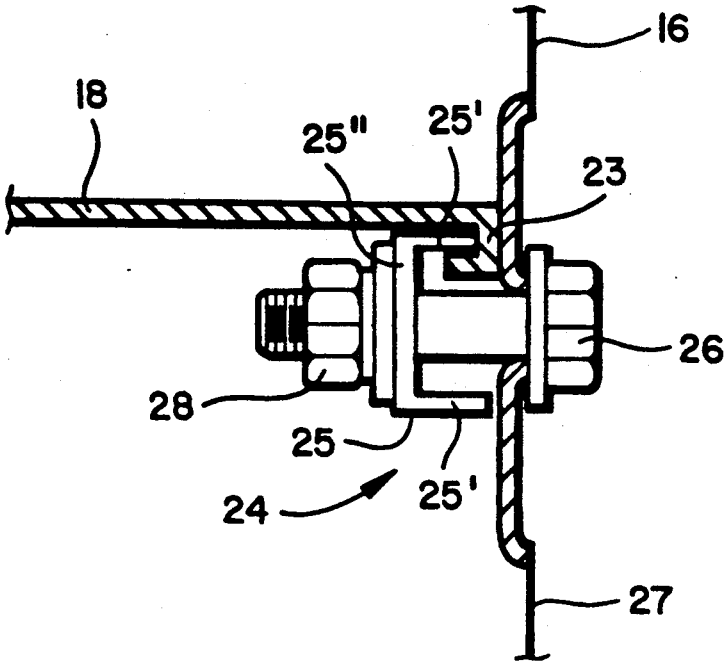
FIG. 3 is a vertical cross-sectional view through the adjustable inner wall and one perforated side wall of one treating chamber in the textile wet processing machine of FIG. 2, taken along line 3—3 thereof, showing the means by which the inner wall is mounted to the side walls.

As thus far described, the wet processing machine 10 is essentially conventional. According to the present invention, the inner wall 18 of the chamber 15 is removably mounted between the perforated chamber side walls 16 to permit selective adjustable repositioning of the inner wall 18 toward and away from the outer chamber wall 17 to change the size of the chamber interior in relation to the particular fabric being processed. As best seen in FIG. 3, the inner wall 18 of the processing chamber 15 is formed with a C-shaped flange 23 along each opposite lateral side edge of the inner wall 18, by which the inner wall 18 is affixed at perforations in the side walls 16 by a plurality of fastener. assemblies, generally indicated at 24. Each fastener assembly 24 comprises a C-shaped bracket 25, either side leg 25' of which is configured to be matably received within either side flange 23 of the inner chamber wall 18. The intermediate leg 25+' of each bracket 25 is formed with a circular opening sized to receive the shaft of a conventional bolt 26. As shown in FIG. 3, the bolt 26 of each fastener assembly 24 is inserted inwardly through a selected perforation 27 in one of the chamber side walls 16 and the corresponding bracket 25 is mounted on the bolt shaft at the inward face of the side wall 16 with one side leg 25 of the bracket 25 engaged within one flange 23 of the inner chamber wall 18, with a nut 28 being tightened onto the projecting end of the bolt 26 to secure the bracket 25 and the flange 23 against the inward surface of the side wall 16.

Figure 4:
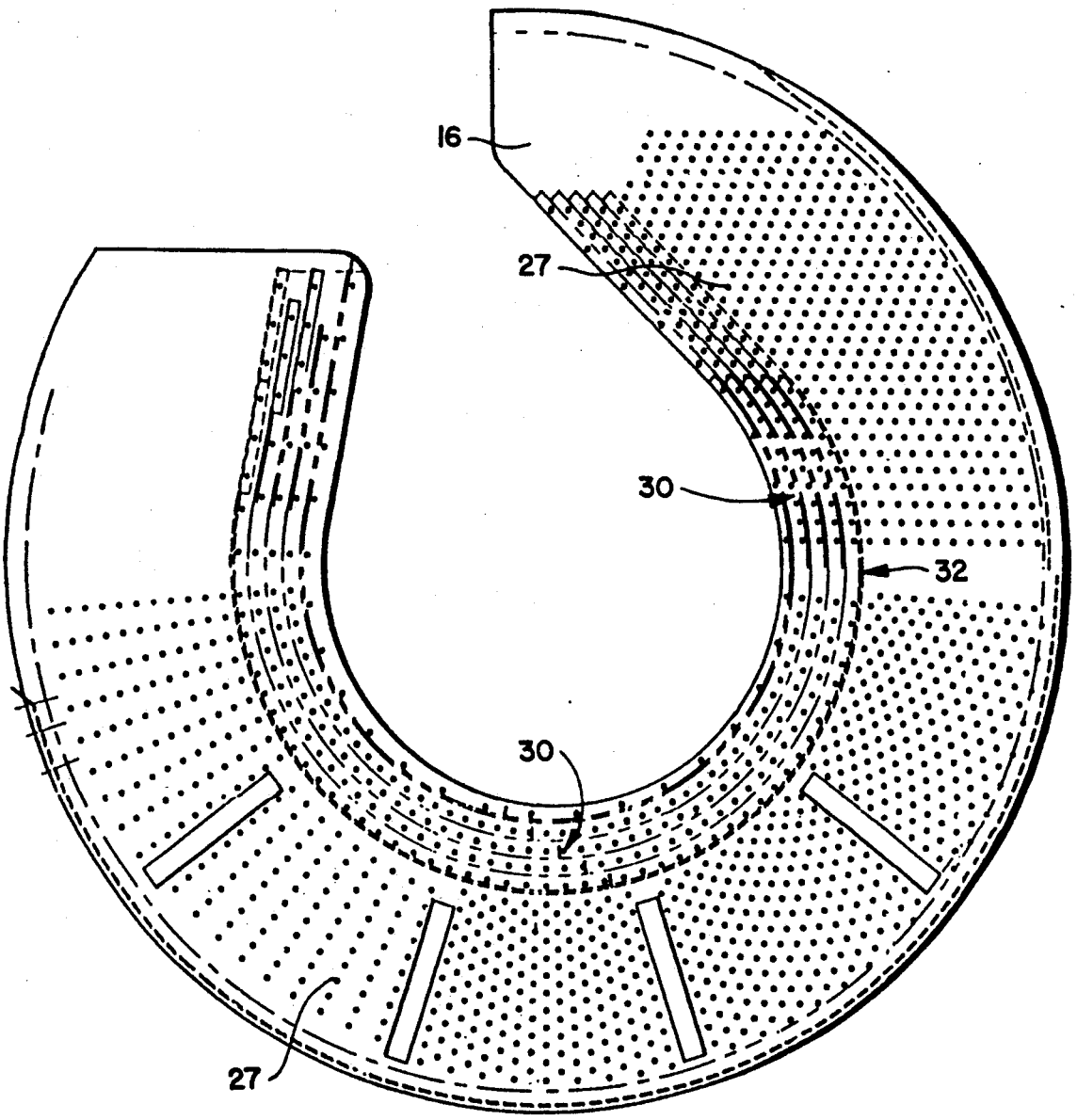
FIG. 4 is an elevational view of one of the perforated side walls of one treating chamber.

As will thus be understood, the inner wall 18 may be mounted in the above-described manner in various dispositions between the side walls 16 of the treating chamber 15 to selectively vary its spacing from the outer chamber wall 17 and thereby correspondingly vary the interior area of the treating chamber 15. Advantageously, the arrangement of the flange 23 along the opposite sides of the inner wall 18 in conjunction with the fastener assembly 24 enables this adjustable mounting to be accomplished utilizing the perforations 27 already conventionally formed in the chamber side walls 16 and without requiring the formation of corresponding perforations in the flanges 23 of the inner wall 18 to mate therewith. In accordance with the present invention, the perforations 27 are preferably formed in the inward area of the chamber side walls 16 adjacent their inner edges in parallel rows following the contour of the inner edge of each side wall 16, as indicated at 30 in FIG. 4, to correspond to differing mounted dispositions for the inner wall 18, indicated at 32 in broken lines in FIG. 4. Preferably, the inner wall 18 is fabricated of a sufficiently flexible material, typically stainless steel, to enable the overall curvature of the inner wall 18 to adjustably conform to the differing mounted dispositions. The inner wall 18 may be fabricated of a single elongate piece of stainless steel or other suitable material or may be fabricated of plural sections fastened end-to-end with one another. For example, in the specific embodiment illustrated, the inner wall 18 may be fabricated of an intermediate curved section with linear end sections affixed to the opposite ends of the curved section.

The use and advantages of the present invention may thus be understood. As those persons skilled in the art will recognize and understand, differing fabrics may behave in differing manners during processing in the same wet processing machine, particularly as regards formation and advancement of the fabric in plug form through the processing chamber of a machine of the present type, depending, for example, on the type of fiber from which the fabric is produced (natural or synthetic fibers or blends thereof), the type of fabric formation (woven, knitted or otherwise), fabric thickness, fabric weight per unit length, etc. As a result, the optimal size of the treating chamber of a wet processing machine, such as the chamber 11 of the machine 10, may vary from one fabric to another in order to enable the maximum processing capacity and most satisfactory processing results to be realized when processing differing fabrics with a given particular machine. For example, with thicker and heavier weight fabrics, a processing chamber of relatively larger cross-sectional area may be necessary or desirable to process a maximum capacity of the fabric, while a processing chamber of relatively smaller cross-sectional area may be necessary to achieve optimal results when processing relatively thinner and lighter weight fabrics. By providing the ability to adjustably reposition the inner wall 18 of the chamber 15, the present invention enables a single processing machine to be utilized with maximum efficiency and results for a wide range of differing fabrics.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a machine for wet processing of textile fabric in continuous cloth rope form, said machine having a vessel for containing processing liquid and a U-shaped chamber within said vessel for recirculation of the cloth rope therethrough in plug form, said U-shaped chamber having perforated side walls to permit liquid to flow therethrough and an outer wall for advance of the cloth plug therealong, the improvement comprising an inner wall for movable disposition between said side walls of said U-shaped chamber in spaced relation to said outer wall and means for selectively affixing said inner wall to said side walls at selected perforations of said side walls for adjustably spacing said inner wall from said outer wall.

2. The improvement in a textile wet processing machine according to claim 1 and characterized further in that said inner wall includes a flange at each lateral side thereof and said affixing means comprises means for clamping each said flange to a respective one of said side walls.

3. The improvement in a textile wet processing machine according to claim 2 and characterized further in that said clamping means comprises a plurality of fasteners each extendable through a perforation of said side walls and a clamp member associated with each fastener for clamping engagement with a flange of said inner wall.

4. The improvement in a textile wet processing machine according to claim 1 and characterized further in that said inner wall is sufficiently flexible to assume a range of curvatures corresponding to differing dispositions of said inner wall affixed to said side walls.

5. The improvement in a textile wet processing machine according to claim 1 and characterized further in that said inner wall is imperforate.

6. The improvement in a textile wet processing machine according to claim 1 and characterized further in that said outer wall is imperforate.

7. The improvement in a textile wet processing machine according to claim 1 and characterized further in that said inner wall is perforate.

8. The improvement in a textile wet processing machine according to claim 1 and characterized further in that said outer wall is perforate.

* * * * *

UNITED STATES PATENT AND TRADEMARK OFFICE

CERTIFICATE OF CORRECTION

PATENT NO. : 5,014,526

DATED : May 14, 1991

INVENTOR(S) : George G. Hacker et al.

It is certified that error appears in the above-identified patent and that said Letters Patent is hereby corrected as shown below:

Column 2, Line 29, reads "jetwet" but should read -- jet-type textile wet --.

Column 4, Lines 2-3, read "fastener. assemblies" but should read -- fastener assemblies --.

Column 4, Line 7, reads "25+'" but should read -- 25" --.

Signed and Sealed this

Twenty-fourth Day of November, 1992

*Attest:*

DOUGLAS B. COMER

*Attesting Officer*

*Acting Commissioner of Patents and Trademarks*